United States Patent [19]

Oliff

[11] Patent Number: 4,703,847

[45] Date of Patent: Nov. 3, 1987

[54] MULTIPACK FOR FLANGED PRIMARY CONTAINERS

[75] Inventor: James R. Oliff, Austell, Ga.

[73] Assignee: The Mead Corporation, Dayton, Ohio

[21] Appl. No.: 8,979

[22] Filed: Jan. 30, 1987

[51] Int. Cl.[4] ..... B65D 5/04

[52] U.S. Cl. ..... 206/140; 206/160; 206/434; 229/40

[58] Field of Search ..... 206/434, 140, 160, 171, 206/175; 229/29 C, 40

[56] References Cited

U.S. PATENT DOCUMENTS

| | | | |
|---|---|---|---|
| 3,014,636 | 12/1961 | Fielding | 206/434 |
| 3,352,453 | 11/1967 | Weiss | 206/140 X |
| 4,164,286 | 8/1979 | Sutherland | 206/434 |
| 4,489,880 | 12/1984 | Calvert | 229/40 |

*Primary Examiner*—William Price
*Attorney, Agent, or Firm*—Erwin Doerr

[57] ABSTRACT

A package accommodating a group of like flanged containers disposed in more than one row includes a top panel (16) and overlapping base panels (12,20) interconnected by spaced side walls (14,18) thereby providing a tubular structure in which the containers are received. The base panels include a keel (K) adapted to separate the containers in one row ($R^1$) from those in an adjacent row ($R^2$). One of the base panels is provided with locking elements (48) adapted to interlock with cooperating locking elements (46) provided by the other of the base panels thereby to maintain the package in its tubular form. Auxiliary cooperating locking elements are provided by the base panels and interlocked to minimize distortion of the keel, and portions of the top flanges (f) of the containers in one row ($R^1$) are overlapped with portions of top flanges of the containers in an adjacent row ($R^2$) and portions of the top panel are interposed between the overlapped portions of the container flanges.

6 Claims, 4 Drawing Figures

MULTIPACK FOR FLANGED PRIMARY CONTAINERS

This invention relates to a package which accommodates a plurality of primary containers arranged in two or more rows. The package is particularly useful for grouping together and supporting a number of containers such as sealed plastics cups having a top flange and which contain foodstuff such as yogurt or other dairy produce.

A number of multipacks of this sort, more usually of the so-called wrap-around type are provided with central keels erected from a base panel of the carton which partially receive and assist in maintaining the cups in secure spaced relationship. Such packages have been found to be susceptible to deformation caused by "racking" of the carton which may occur when the paperboard material of the carton is wet. This often results in deformation typified by permanent stretching of the paperboard material which creates a loose and insecure package.

The present invention seeks to minimise deformation of such cartons caused by "racking" and thereby improve the seucrity of the cartons.

One aspect of the invention provides a package accommodating a group of like containers disposed in more than one row, the package including a top panel and base panel means interconnected by spaced side walls thereby providing a tubular structure in which said containers are received, said base panel means including a keel adapted to separate the containers in one row from those in an adjacent row, one base panel being provided with locking means adapted to interlock with cooperating locking means provided by a base panel overlapped with said one base panel thereby to maintain the package in its tubular form, characterised by auxiliary cooperating locking means provided by said base panels which are interlocked to minimise distortion of said keel.

Another aspect of the invention provides a package accommodating a group of like flanged containers disposed in more than one row, the package including a top panel and base panel means interconnected by spaced side walls thereby providing a tubular structure in which said containers are received, characterised in that portions of top flanges of the containers in one row are overlapped with portions of top flanges of the containers in an adjacent row and in that portions of said top panel are interposed between said overlapped portions of the container flanges.

Yet another aspect of the invention provides a package accommodating a group of like flanged containers disposed in more than one row, the package including a top panel and base panel means interconnected by spaced side walls thereby providing a tubular structure in which said containers are received, said base panel means including a keel adapted to separate the containers in on row from those in an adjacent row, one base panel being provided with locking means adapted to interlock with cooperating locking means provided by a base panel overlapped with said one base panel thereby to maintain the package in its tubular form, characterised by auxiliary cooperating locking means provided by said base panels which are interlocked to minimise distortion of said keel, in that portions of top flanges of the containers in one row are overlapped with portions of top flanges of the containers in an adjacent row and in that portions of said top panel are interposed between said overlapped portions of the container flanges.

An embodiment of the invention will now be described, by way of example, with reference to the accompanying drawings in which FIG. 1 is a plan view of a wrapper bland for forming a package according to the invention;

Figure 1:
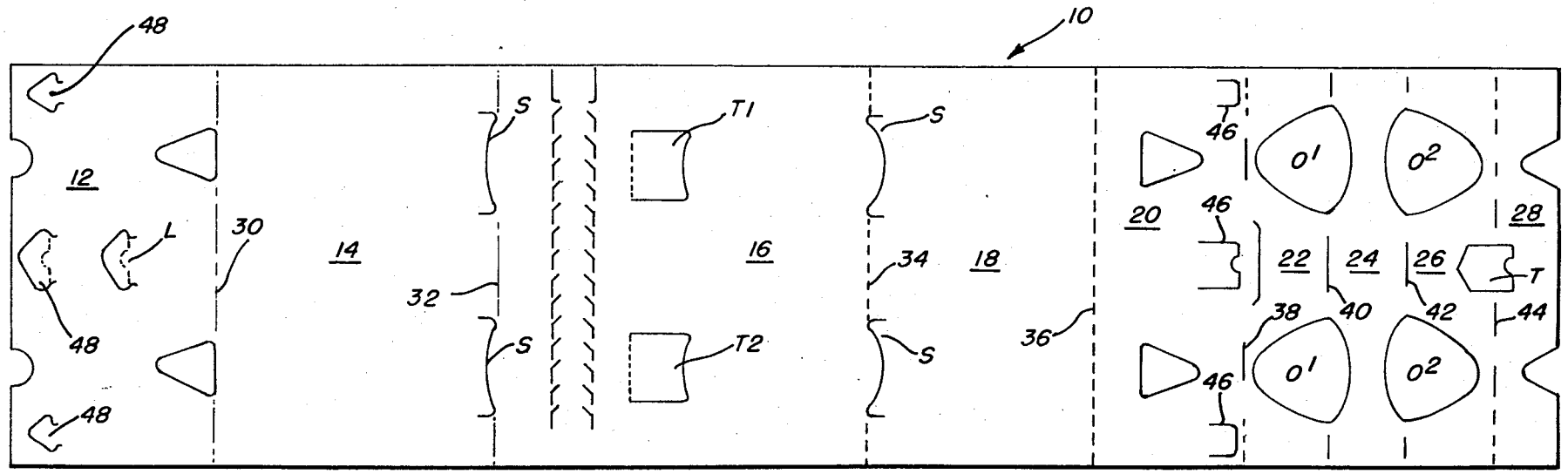

Referring to the drawings, a wrapper blank 10 is formed from a single sheet of paperboard or similar foldable sheet material and comprises, in series, a first base panel 12; a first side wall panel 14; a top panel 16; a second side wall panel 18; a second base panel 20; a first keel side wall 22; a keel top wall 24; a second keel side wall 26; and an end panel 28 hinged one to the next along transverse fold lines 30–44 respectively.

The first and second keel side wall 22 and 26 together with the keel top wall 24 provide a central keel 'K' in the completed package which spaces apart rows $R^1$, $R^2$ of cups and also locates, at least partially, the individual cups in each row. In order to provide for the location of each cup a row $O^1$, $O^2$ of generally ovate apertures is struck from the blank along fold lines 40 and 42 respectively. The apertures in row $0^1$ are therefore provided by material removed partially from keel side wall 22 and keel top wall 24. Similarly, the apertures in row $O^2$ are provided by material removed partially from keel side wall 26 and keel top wall 24. The transverse fold lines 40 and 42 contain the major axes of the rows of apertures $O^1$ and $O^2$ and the arcuate perimeter of each aperture on either side of its major axis has a different radius of curvatures so as to be able to retain base portions of the containers to be packaged.

When the keel 'K' is erected the apertures $O^1$, $O^2$ form scalloped recesses on either side of keel 'K' each to receive and locate a peripheral wall portion of a cup. In order to erect the centre keel 'K', the blank is folded about fold lines 38, 40, 42 and 44 so that the adjacent edges (defined by fold lines 38 and 44) of base panel 20 and end panel 28 are drawn into abutting relationship. The p anels of the keel are sized so that when the base panels are drawn together the keel K will form a transverse structure of approximately channel shaped cross-section but in which the keel side wall 22 and 26 are somewhat convergent in a direction away from the keel top wall 24. The keel top wall lies in a plane parallel to the base panels of the package. In order to maintain the keel more rigid in its erected condition and less susceptible to deformation as a result of "racking" of the carton, an auxiliary locking arrangement is provided. The auxiliary locking arrangement comprises a hinged retaining tab 'T' defining a locking aperture spanning the transverse fold line 44 and a cooperating locking tab 'L' disposed substantially centrally of the base panel 12. As is well known in the art, in order to maintain the wrapper blank wrapped around the packaged articles, locking elements are provided to lock together the base panels. In this regard, base panel 20 is formed with hinged retaining tabs which define locking apertures 46 at spaced locations adjacent keel side panel 22 and cooperating locking tabs 48 are struck from base panel 12. The locking tabs are inserted into the locking apertures in known manner to lock the base panels in overlapping relationship.

The keel is sized so that the rows $R^1$ and $R^2$ are spaced apart but the arrangement is such (FIG. 2) that peripheral portions of the top flanges 'f' of the containers in row $R^2$ are overlapped by peripheral portions of the top flanges 'f' of the containers in row $R^1$. However, in order to prevent damage to the tops of the containers in row $R^2$ a portion of the carton top wall in the form of downwardly displaced tabs $T^1$, $T^2$ is interposed between the overlapped flange portions of the containers. the interposed tabs not only minimise damage arising from abrasion created during relative movement between the containers but also makes the carton less susceptible to deformation as a result of racking in a direction 'X' which is opposite to that which tends to cause deformation of the keel 'K'.

Figure 2:
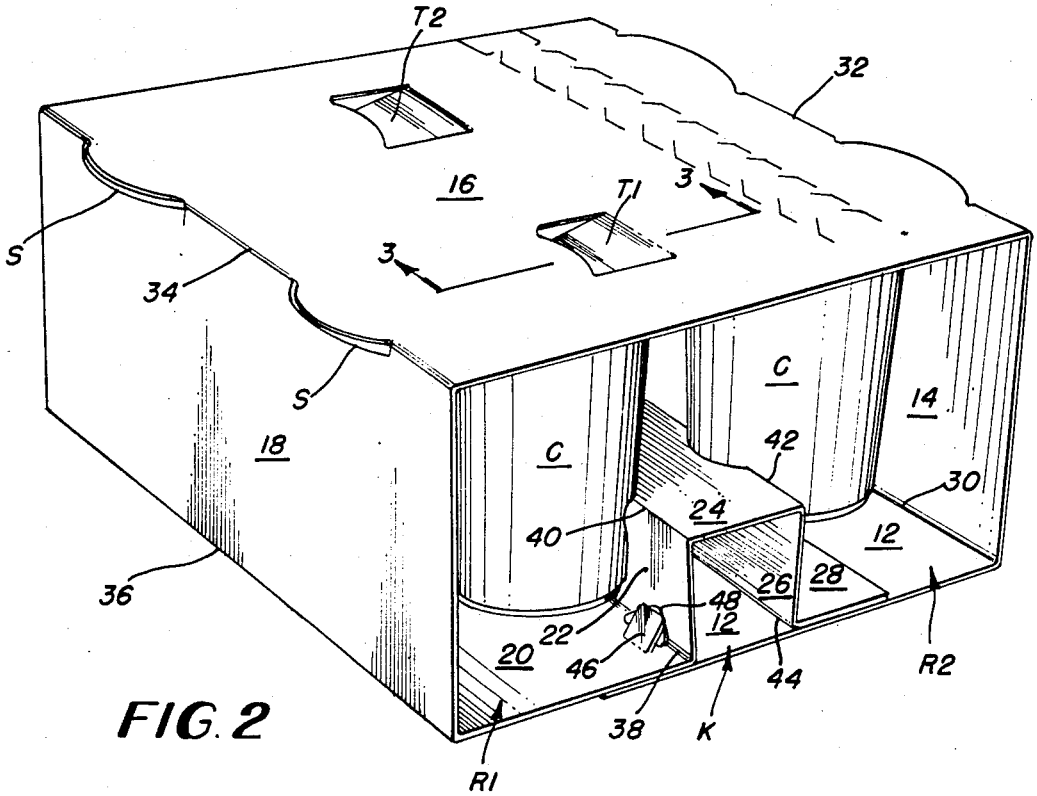
FIG. 2 is a perspective view of the completed package according to the invention.
Figure 3:
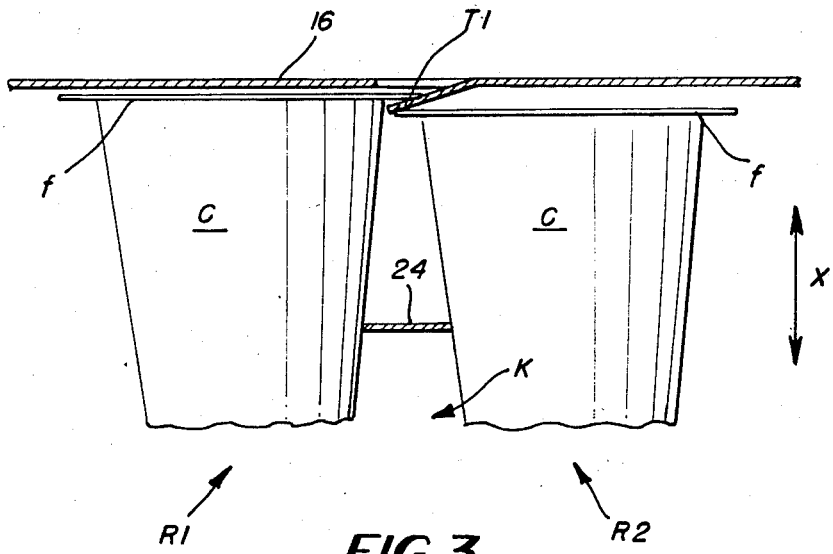
FIG. 3 is a part cross-sectional view taken on the line 3—3 in FIG. 2.
Figure 4:
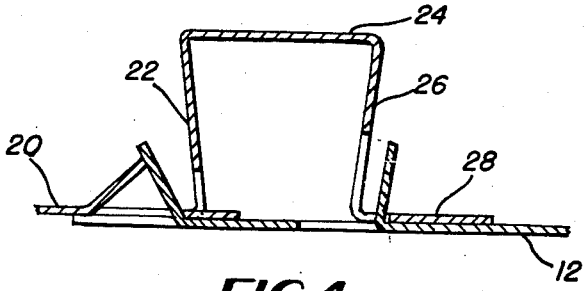
FIG. 4 is a cross-sectional view of an auxiliary locking arrangement for the centre keel of the carton.

In order to form the completed package shown in FIG. 2, first the blank is laid onto the tops of a group of containers 'C' which are arranged in two rows $R^1$, $R^2$ in known manner so that the top panel 16 overlies the tops of the cups in rows $R^1$, $R^2$ and the base panels are secured together beneath the containers with the keel therebetween as previously described.

During application of the wrapper blank retaining slits 'S' which are struck from the blank along fold lines 32 and 34 engage flange portions of the cups in order to assist in the retention of the cups from endwise dislodgement from the package.

I claim:

1. A package accommodating a group of like containers disposed in more than one row, the package including a top panel and overlapping base panels interconnected by spaced side walls thereby providing a tubular structure in which said containers are received, said base panels including a keel formed to separate the containers in one row from those in an adjacent row, one of said base panels being provided with locking means arranged to interlock with cooperating locking means provided by another of said base panels to maintain the package in its tubular form, and an auxiliary cooperating locking means being provided by said base panels and interlocked to minimize distortion of said keel, characterised in that said locking means is provided between said keel and one of said side walls of the package and said auxiliary locking means is arranged between said keel and the opposite side wall of the package whereby said base panels are locked in overlapped relationship at spaced locations on opposite sides of said keel.

2. A package accommodating a group of like containers having outwardly projecting flanges at the tops thereof and being disposed in more than one row, the package including a top panel and base panel means interconnected by spaced side walls thereby providding a tubular structure in which said containers are received, characterized in that portions of the flanges of containers in one row are overlapped with portions of the flanges of containers in an adjacent row and in that portions of said top panel are interposed between said overlapped portions of said container flanges.

3. A package accommodating a group of like containers having outwardly projecting flanges at the tops thereof and being disposed in more than one row, the package including a top panel and overlapping base panels interconnected by spaced side walls therby providing a tubular structure in which said containers are received, said base panels including a keel formed to separate the containers in one row from those in an adjacent row, one of said base panels being provided with locking tabs arranged to interlock with cooperating locking apertures provided by another of said base panels to maintain the package in its tubular form, characterised in that auxiliary cooperating locking means are provided by said base panels and interlocked to minimise distortion of said keel and in that inwardly extending portions of the flanges of containers in one row are overlapped with portions of the flanges of containers in an adjacent row and in that portions of said top panel are interposed between the overlapped portions of said flanges.

4. The package according to claim 2 further characterised in that said portions of the top panel comprise hinged tabs displaced downwards into the tubular structure, the free ends of said hinged tabs being engaged with the containers in said one row against the undersides of the container flanges.

5. An elongated blank for forming a package of the wrap-around type which blank is formed from paperboard or like foldable material and comprises in series, a first base panel, a first side wall panel, a top panel, a second side wall panel, a second base panel, a first keel side wall, a keel top wall, a second keel side wall and an end panel hinged one to the next along transverse fold lines, said first base panel comprising primary locking means for cooperation with complementary locking means formed in said second base panel, characterised in that an auxiliary locking means is provided by said first base panel for cooperation with complementary locking means formed partially in both of said second keel side wall and said end panel.

6. The blank according to claim 5, further characterised in that said auxiliary locking means in said first base panel is spaced longitudinally from said primary locking means.

* * * * *